United States Patent [19]

Benson

[11] 3,948,223

[45] Apr. 6, 1976

[54] SERIALLY FIRED STEAM GENERATOR

[75] Inventor: Elliot Warren Benson, Verona, N.J.

[73] Assignee: Foster Wheeler Energy Corporation, Livingston, N.J.

[22] Filed: Jan. 2, 1975

[21] Appl. No.: 538,073

[52] U.S. Cl. ..... 122/240 A; 110/1 J; 122/478; 431/10

[51] Int. Cl.[2] .. F22B 33/00; F22G 7/00; F23M 3/04

[58] Field of Search ..... 110/1 J, 72 R; 122/240 R, 122/240 A, 240 B, 478; 431/10

[56] References Cited

UNITED STATES PATENTS

| | | | |
|---|---|---|---|
| 2,646,790 | 7/1953 | Reygagne | 431/10 X |
| 2,865,344 | 12/1958 | Firl | 110/1 |
| 2,968,288 | 1/1961 | Zoschak et al. | 122/240 |
| 3,048,131 | 8/1962 | Hardgrove | 431/10 X |
| 3,421,824 | 1/1969 | Herbst | 431/10 |

*Primary Examiner*—Kenneth W. Sprague
*Attorney, Agent, or Firm*—Marvin A. Naigur; John E. Wilson

[57] ABSTRACT

A steam generator consists of several units in which combustion air is mixed with fuel at furnace sections placed in series. An excess of combustion air is used in the first furnace section and the exhaust gases which include unused combustion air are led into another furnace where fuel is added in sufficient quantities to use at least a portion of the combustion air which was not used in said first furnace.

3 Claims, 1 Drawing Figure

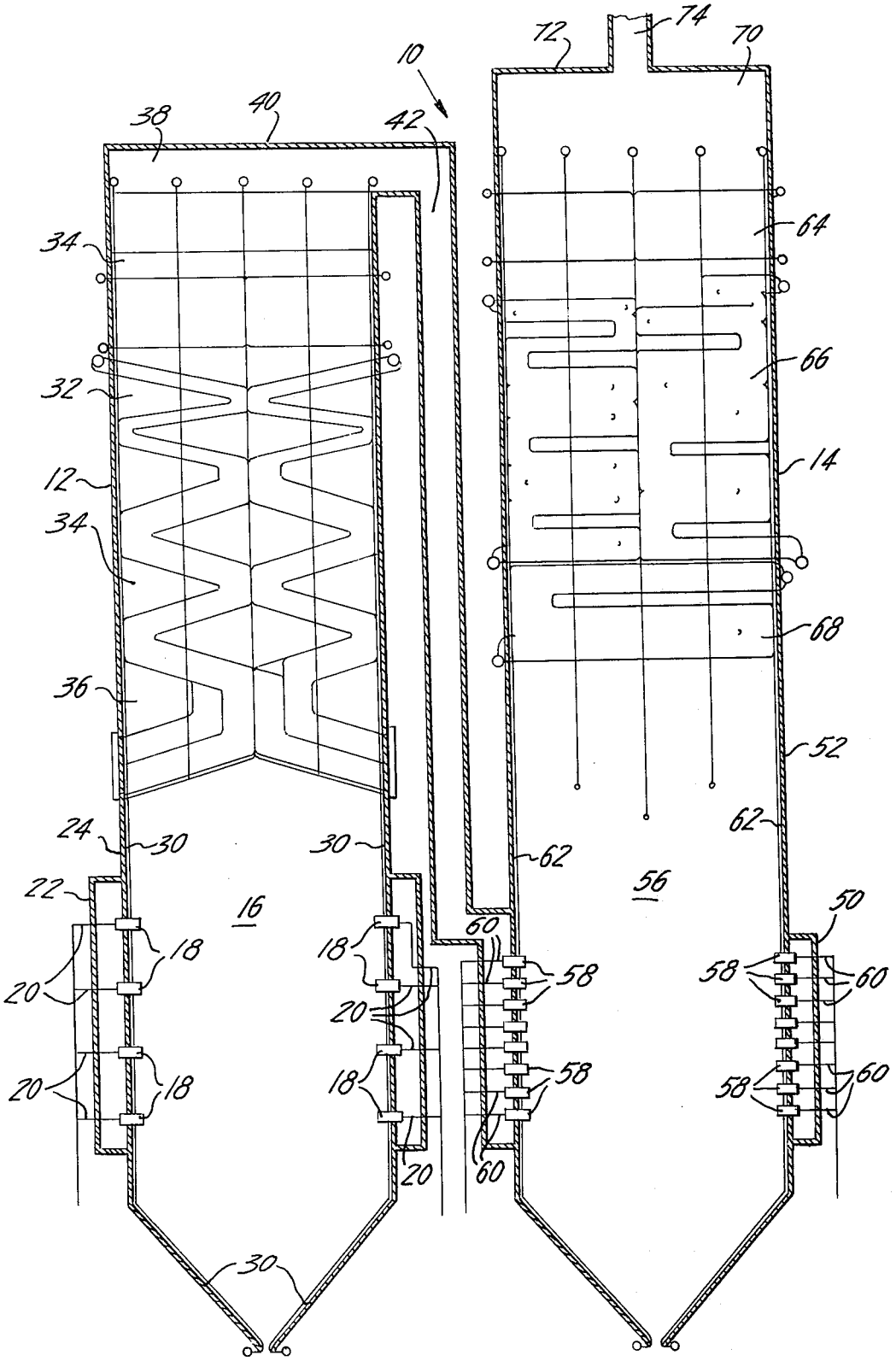
10
12
14
16
18
20
22
24
30
32
34
36
38
40
42
50
52
56
58
60
62
64
66
68
70
72
74

SERIALLY FIRED STEAM GENERATOR

BACKGROUND OF THE INVENTION

Most sources of energy today are objectionable in that they pollute the atmosphere. When fuel is combusted in an internal combustion engine or for a gas turbine or a furnace which is used to produce steam, the combustion products are often objectionable in that they contain large amounts of pollutants. Among the pollutants are the gases which are oxides of nitrogen. Such gases are recognized as being hazardous to health and harmful to the environment.

In order to convert as much heat to useful energy as possible, combustion air is usually kept to a minimum to limit the amount of exhaust gas produced and therefore the heat lost in the escaping gas. This makes for a very high combustion temperature.

It is recognized that the oxides of nitrogen are produced from combustion air at temperatures above about 2800° F., and that the higher the temperature, the larger the amount of nitrogen oxides produced. Thus the production of oxides of nitrogen can be decreased by lowering combustion temperatures. Reducing temperatures of combustion in the combustion zone of a machine producing useful energy, however, will reduce its efficiency as well as its capacity for producing energy.

High combustion temperatures are undesirable because they require a design which provides for cooling mechanical components and increase the possibility of their failure through overheating. Further, when certain fuels are burned at a high temperature, undesirable products of combustion, such as slag, form to lower efficiency.

SUMMARY OF THE INVENTION

It is an object of the present invention to overcome drawbacks found in the prior art such as those discussed above. Accordingly, a first combustion zone and a second combustion zone are placed in series, the first combustion zone being provided with an excess of combustion air so that the exhaust gases of the first combustion zone will contain unburned combustion air which can be led into the second combustion zone where fuel is added in sufficient quantities to burn at least some of the excess combustion air of the first combustion zone, both of the combustion zones furnishing heat to produce energy.

BRIEF DESCRIPTION OF THE DRAWING

The drawing is a side view, partly in section, showing a steam generator made in accordance with the present invention.

DETAILED DESCRIPTION OF THE PREFERRED EMBODIMENT

The drawing shows a steam generator indicated generally as 10 having a first unit 12 and a second unit 14. The first unit 12 has a combustion zone or furnace section 16 which, during operation, has flames generated by burners 18 which are fed fuel such as oil, gas or coal through lines 20. The fuel travelling in the lines 20 is mixed with combustion air. The air in the lines 20 is commonly called "primary air" and enters the furnace section 16 through burners 18 to provide enough oxygen to burn some of the fuel. More combustion air is supplied through the windbox 22 which extends annularly around a side wall 24 which is generally rectangular in plan. The combustion air entering the furnace portion 16 through the windbox 22 is commonly called "secondary air". The burners 18 extend through the side wall 24 so that their inner ends are within the furnace portion 16 while their outer ends are within the windbox 22. The secondary air enters the furnace portion 16 through flow passes each of which is generally annular with respect to one of the burners 18.

The inside of the furnace section 16 is lined with water tubes 30 in which water is heated. Above the furnace section 16 is a convection section 32 extending horizontally through the convection section 32 is an economizer 34. Below the economizer 34 is a large evaporator section 36. The economizer 34 and the evaporator 36 have inlet and outlet headers which are conventional and shown on the drawing.

Above the economizer 34 is a space 38 which is defined by the side wall 24 and a roof 40. The space 38 is connected by a duct 42 which places the space 38 in communication with a windbox 50 on the second unit 14.

A second unit 14 has a side wall 52 which defines, in plan, a rectangle which extends generally vertically. The second unit 14 includes a second combustion zone in the form of a furnace section 56 which is fired by a plurality of burners 58 which are fed fuel through fuel lines 60. The burners 58 project through the side wall 52 so that one end is in the furnace section 56 and the other end is in the windbox 50. Each of the burners is supplied with fuel and primary air through fuel lines 60 and with secondary combustion air through the windbox 50.

The furnace portion 56 is lined with tubes 62 which may be used to generate steam from water just as the tubes 30 which line the furnace section 16 of the first unit 12.

The exhaust gases from the furnace portion 52 pass upwardly over an economizer section 64 with appropriate inlet and outlet headers. Below the economizer section 64 is a reheater section 66 and below the reheater section 66 is a superheater section 68. The exhaust gases from the furnace section 56 pass upward to supply heat to the superheater 68, reheater 66 and economizer 64. Thereafter the gas is passed into a space 70 under a roof 72 to thereafter pass through an exhaust 74 which is located in the roof 72.

The first unit is fired with an excess of air so that approximately 90% more than is needed to completely combust the fuel is used. If both units are approximately 178 feet high and the furnace of the first unit 12 is approximately 20 feet wide and 40 feet deep with all surfaces designed to extract a maximum amount of heat, firing one third of the total fuel in the first unit will yield an adiabatic flame temperature within the first unit of approximately 2583° F.

The windbox temperature in the second unit will be approximately 650°.

The second unit is 40 feet wide and 40 feet deep. In the second unit, additional fuel is fired and the flame is diluted by the exhaust gases and unburned combustion air which come through the windbox 50. Additional secondary air can be supplied through the windbox 50. With this arrangement the adiabatic flame temperature of the second unit will also be about 2583° F.

Thus, at no place in the present steam generator is the flame temperature above 2800° F. Thus, essentially no oxides of nitrogen should be produced by the present steam generator.

One possible explanation as to why the adiabatic flame temperatures are so low in the present invention can be found by analysing it from a heat balance viewpoint.

The amount of heat which is required to be available at the burners equals the sum of the sensible heat of the gases leaving the economizer, the total steam generator output of the unit, radiation losses and other minor losses which can occur between the location at which the gases leave the economizer and the burners. In a conventional single unit the available heat at the burners must be greater than the available heat at the burners 58 of the second unit 14 because in the second unit 14 only a portion of the heat which is supplied to create the total output is supplied between the burners 58 and the exhaust 74. The gas weight through the second unit is the same as for a conventional single unit having the same total output as units 14 and 18 combined. Thus, the available heat at the burners per pound of gas through such a conventional unit would be higher than in the unit 14. Thus, the adiabatic flame temperature in the unit 18 is a function of its output. Since the output of the unit 14 is only a portion of the total steam generator output it is substantially less than the output of a conventional single unit steam generator and the adiabatic flame temperature is correspondingly less than that of a conventional unit.

The adiabatic flame temperature at burners 18 in the first unit 12 is also a function of the output of that unit and since the output of unit 12 is only a fraction of the total steam generator output, the adiabatic flame temperatures at burners 18 are lower than they would be if the burners 18 had to supply enough heat for a unit generating the total steam generator output.

By properly designing a steam generator in accordance with the present invention the gas temperatures can be maintained so that the production of the oxides of nitrogen is minimized.

The present design allows for the adjustment of firing rates between the units to thereby control the amount of steam generated. This allows for the control of the steam temperatures over a great range in load, and over a variety of furnace conditions, for example, those caused by dirt and/or slag. The present design also allows the firing rates to be adjusted for the differences in the characteristics of various fuels used within the furnace.

Further, in the present invention the temperatures are low enough so that little, if any, slag will form.

Still another advantage found in the present design is that it can be started up rather quickly. This is so because the first unit can be fired to heat the economizer and evaporator sections to provide steam to get a power plant started without having to protect an uncooled superheater or reheater. This is so, of course, because the superheater 94 is positioned entirely within the second unit which need not be fired until steam to be superheated is made available at the superheater 92.

The foregoing describes but one preferred embodiment of the present invention, other embodiments being possible without exceeding the scope thereof as defined in the following claims.

What is claimed is:

1. The method of producing heat energy comprising the steps of:

providing fuel;

providing combustion air considerably in excess of that which is required for complete combustion at a first combustion zone;

burning the mixture of fuel and excess combustion air in said first combustion zone;

leading the exhaust gases including the excess combustion air from the first combustion zone to a second combustion zone;

adding combustion air, in addition to that contained in the exhaust gases from the first combustion zone at said second combustion zone;

providing additional fuel to be burned at said second combustion zone;

burning said additional fuel in the presence of the exhaust gases from said first combustion zone and in the presence of said added combustion air;

whereby the excess combustion air furnished at said first combustion zone and the exhaust gases furnished at said second combustion zone will prevent the temperatures within said combustion zones from rising above that at which oxides of nitrogen are substantially produced.

2. The method defined in claim 1 comprising the further steps of placing said exhaust gases from said first combustion zone in indirect heat exchange with water to produce steam before said exhaust gases from said first combustion zone are led to said second combustion zone and using the heat produced in said second combustion zone to superheat steam.

3. An apparatus for producing heat energy comprising:

a first unit having a first combustion zone;

a second unit having a second combustion zone;

means for supplying fuel and an amount of combustion air considerably in excess of that required to complete the combustion of said fuel to said first combustion zone;

means for flowing the exhaust gas from said first combustion zone into said second combustion zone;

means for adding fuel to said second combustion zone to combust said fuel in the presence of the exhaust gases from said first combustion zone;

tubes in said first unit for flowing water close to said first combustion zone so that said water is heated and generated into steam; and a superheater, said superheater being disposed in said second unit and heated by said second combustion zone.

* * * * *